US011810505B2

(12) United States Patent
Lee et al.

(10) Patent No.: US 11,810,505 B2
(45) Date of Patent: Nov. 7, 2023

(54) ELECTRONIC DEVICE COMPRISING DISPLAY

(71) Applicant: SAMSUNG ELECTRONICS CO., LTD., Suwon-si (KR)

(72) Inventors: Minwoo Lee, Suwon-si (KR); Seoyoung Lee, Suwon-si (KR); Juseok Lee, Suwon-si (KR); Youngdo Kim, Suwon-si (KR); Sungha Park, Suwon-si (KR); Woonbo Yeo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/882,492

(22) Filed: Aug. 5, 2022

(65) Prior Publication Data

US 2022/0375384 A1 Nov. 24, 2022

Related U.S. Application Data

(63) Continuation of application No. PCT/KR2021/001574, filed on Feb. 5, 2021.

(30) Foreign Application Priority Data

Feb. 6, 2020 (KR) ..... 10-2020-0014551
Feb. 10, 2020 (KR) ..... 10-2020-0015954
Feb. 11, 2020 (KR) ..... 10-2020-0016605

(51) Int. Cl.
*G09G 3/3225* (2016.01)
*G09G 3/20* (2006.01)

(52) U.S. Cl.
CPC ..... *G09G 3/3225* (2013.01); *G09G 3/20* (2013.01); *G09G 2310/0267* (2013.01);
(Continued)

(58) Field of Classification Search
CPC ..... G09G 5/12; G09G 5/003; G09G 3/20; G09G 3/2092; G09G 2330/028;
(Continued)

(56) References Cited

U.S. PATENT DOCUMENTS 6,900,820 B2 5/2005 Kataoka et al.
8,884,977 B2 11/2014 Wang
(Continued)

FOREIGN PATENT DOCUMENTS

CN 110310600 A 10/2019
KR 10-2008-0040281 5/2008
(Continued)

OTHER PUBLICATIONS

International Search Report for PCT/KR2021/001583, dated May 28, 2021, 2 pages. (English Translation).
(Continued)

*Primary Examiner* — Shaheda A Abdin
(74) *Attorney, Agent, or Firm* — Nixon & Vanderhye P.C.

(57) ABSTRACT

An electronic device may include a display panel, a display driver IC (integrated circuit) and a processor, wherein the display driver IC may set an output time (horizontal time) of one of lines constituting the display panel to a first time period, set a number of vertical blank lines for the display panel to a first number, drive the display panel at a first refresh rate corresponding to the first time period and the first number of the vertical blank lines, receive a control signal for changing from the first refresh rate to a second refresh rate from the processor, and set the output time to a second time period or set the number of the vertical blank lines to a second number and drive the display panel based on the control signal, and wherein the display panel may be driven at a second refresh rate while the second time period and the second number of vertical blank lines are being set.

15 Claims, 9 Drawing Sheets

| R/R | V_Blank | 1H Time(μs) |
|---|---|---|
| 120Hz | 24 | 3.43 |
| 60Hz | 268 | 6.25 |

(52) U.S. Cl.
CPC . *G09G 2310/08* (2013.01); *G09G 2320/0247* (2013.01); *G09G 2320/0276* (2013.01); *G09G 2320/0606* (2013.01); *G09G 2320/0626* (2013.01); *G09G 2320/0673* (2013.01); *G09G 2330/021* (2013.01); *G09G 2330/028* (2013.01); *G09G 2340/0435* (2013.01); *G09G 2360/16* (2013.01)

(58) Field of Classification Search
CPC ..... G09G 2360/144; G09G 2310/0267; G09G 2340/0435; G09G 2320/0673; G09G 2320/0626
See application file for complete search history.

(56) References Cited

U.S. PATENT DOCUMENTS

| | | | | |
|---|---|---|---|---|
| 8,902,207 | B2 | 12/2014 | Ryu et al. | |
| 9,019,188 | B2 | 4/2015 | Han et al. | |
| 9,240,031 | B1 | 1/2016 | Wang | |
| 9,262,987 | B2 | 2/2016 | Albrecht et al. | |
| 9,299,301 | B2 | 3/2016 | Choi et al. | |
| 9,318,069 | B2 | 4/2016 | Nambi et al. | |
| 9,378,697 | B2 | 6/2016 | Fujioka et al. | |
| 9,501,993 | B2 | 11/2016 | Nambi et al. | |
| 9,524,694 | B2 | 12/2016 | Wang et al. | |
| 9,601,074 | B2 | 3/2017 | Fujioka et al. | |
| 9,620,064 | B2 | 4/2017 | Albrecht et al. | |
| 9,672,792 | B2 | 6/2017 | Choi et al. | |
| 9,697,758 | B2 | 7/2017 | Watanabe et al. | |
| 9,761,201 | B2 | 9/2017 | Tanaka et al. | |
| 9,847,056 | B2 | 12/2017 | Shimizu et al. | |
| 9,865,231 | B2 | 1/2018 | Kim et al. | |
| 9,953,613 | B2 | 4/2018 | Sacchetto et al. | |
| 9,984,664 | B2 | 5/2018 | Glen et al. | |
| 10,019,968 | B2 | 7/2018 | Bi et al. | |
| 10,033,936 | B2 | 7/2018 | Nakajima | |
| 10,043,492 | B2 | 8/2018 | Woo et al. | |
| 10,049,642 | B2 | 8/2018 | Ansari | |
| 10,056,050 | B2 | 8/2018 | Nambi et al. | |
| 10,096,080 | B2 | 10/2018 | Kwa et al. | |
| 10,210,845 | B2 | 2/2019 | Glen et al. | |
| 10,467,964 | B2 | 11/2019 | Gupta et al. | |
| 10,553,149 | B2 | 2/2020 | Bae et al. | |
| 10,580,336 | B2 | 3/2020 | Jang et al. | |
| 10,600,379 | B2 | 3/2020 | Nambi et al. | |
| 10,692,456 | B2 | 6/2020 | Choi et al. | |
| 10,755,622 | B2 | 8/2020 | Kong et al. | |
| 10,810,930 | B2 | 10/2020 | Shim et al. | |
| 10,891,915 | B2 | 1/2021 | Koo et al. | |
| 10,950,206 | B2 | 3/2021 | Kim et al. | |
| 11,120,734 | B2 | 9/2021 | Bae et al. | |
| 11,289,048 | B2 | 3/2022 | Koo et al. | |
| 11,308,841 | B2 | 4/2022 | Sato et al. | |
| 11,328,661 | B2 | 5/2022 | Lee et al. | |
| 11,403,984 | B2 | 8/2022 | Lee et al. | |
| 11,568,825 | B2 | 1/2023 | Zhang et al. | |
| 2002/0021275 | A1 | 2/2002 | Kataoka et al. | |
| 2008/0106542 | A1 | 5/2008 | Park et al. | |
| 2009/0244112 | A1 | 10/2009 | Jung et al. | |
| 2011/0057917 | A1 | 3/2011 | Ryu et al. | |
| 2014/0055476 | A1 | 2/2014 | Wang | |
| 2014/0198114 | A1* | 7/2014 | Nambi | G09G 3/3618 345/522 |
| 2014/0267370 | A1 | 9/2014 | Albrecht et al. | |
| 2014/0267448 | A1 | 9/2014 | Albrecht et al. | |
| 2014/0368492 | A1 | 12/2014 | Fujioka et al. | |
| 2015/0130823 | A1 | 5/2015 | Kim et al. | |
| 2015/0248873 | A1* | 9/2015 | Tanaka | G09G 3/3648 345/99 |
| 2015/0287352 | A1 | 10/2015 | Watanabe et al. | |
| 2015/0379665 | A1 | 12/2015 | Kwa et al. | |
| 2015/0379918 | A1* | 12/2015 | Tann | G09G 3/2092 345/209 |
| 2016/0093248 | A1 | 3/2016 | Shimizu et al. | |
| 2016/0125785 | A1 | 5/2016 | Wang et al. | |
| 2016/0267870 | A1* | 9/2016 | Fujioka | G09G 3/3677 |
| 2016/0275905 | A1 | 9/2016 | Sacchetto et al. | |
| 2016/0275916 | A1 | 9/2016 | Glen et al. | |
| 2016/0329033 | A1 | 11/2016 | Woo et al. | |
| 2017/0104909 | A1 | 4/2017 | Nakajima | |
| 2017/0193971 | A1 | 7/2017 | Bi et al. | |
| 2018/0018910 | A1 | 1/2018 | Jang et al. | |
| 2018/0053463 | A1 | 2/2018 | Kong et al. | |
| 2018/0174551 | A1 | 6/2018 | Ansari | |
| 2018/0247616 | A1 | 8/2018 | Glen et al. | |
| 2018/0301121 | A1 | 10/2018 | Kim et al. | |
| 2018/0350313 | A1 | 12/2018 | Nambi et al. | |
| 2019/0057643 | A1 | 2/2019 | Bae et al. | |
| 2019/0371264 | A1 | 12/2019 | Koo et al. | |
| 2020/0043432 | A1 | 2/2020 | Choi et al. | |
| 2021/0183290 | A1 | 6/2021 | Sato et al. | |
| 2021/0201738 | A1 | 7/2021 | Song et al. | |
| 2021/0201793 | A1 | 7/2021 | Lin et al. | |
| 2021/0248957 | A1 | 8/2021 | Lee et al. | |
| 2022/0114956 | A1 | 4/2022 | Lee et al. | |

FOREIGN PATENT DOCUMENTS

| | | |
|---|---|---|
| KR | 10-2008-0055133 | 6/2008 |
| KR | 10-2011-0026152 | 3/2011 |
| KR | 10-1076445 | 10/2011 |
| KR | 10-2011-0136775 | 12/2011 |
| KR | 10-2015-0055503 | 5/2015 |
| KR | 10-2015-0068475 | 6/2015 |
| KR | 10-2016-0053377 | 5/2016 |
| KR | 10-2017-0098314 | 8/2017 |
| KR | 10-1774127 | 9/2017 |
| KR | 10-2018-0059017 A | 6/2018 |
| KR | 10-1954934 | 3/2019 |
| KR | 10-1992879 | 6/2019 |
| KR | 10-2020-0010689 | 1/2020 |

OTHER PUBLICATIONS

International Search Report for PCT/KR2021/001574, dated May 28, 2021, 2 pages. (English Translation).
International Search Report for PCT/KR2021/001130, dated Jun. 4, 2021, 2 pages. (English Translation).
Notice of Allowance for U.S. Appl. No. 17/270,687, dated Mar. 3, 2022, 21 pages.
Office Action for U.S. Appl. No. 17/267,384, dated Feb. 18, 2022, 29 pages.
European Extended Search Report dated Jan. 31, 2023 for EP Application No. 21751133.6.
Notice of Allowance dated Feb. 17, 2023 for U.S. Appl. No. 17/944,584.
Extended European Search Report dated May 9, 2023 for EP Application No. 21751065.0.
Korean Office Action dated Sep. 18, 2023 for KR Application No. 10-2020-0016605.
Korean Office Action dated Sep. 18, 2023 for KR Application No. 10-2020-0014551.

* cited by examiner

| R/R | V_Blank | 1H Time(μs) |
|---|---|---|
| 120Hz | 24 | 3.43 |
| 60Hz | 268 | 6.25 |

ELECTRONIC DEVICE COMPRISING DISPLAY

CROSS REFERENCE TO RELATED APPLICATIONS

This application is a continuation of International Application No. PCT/KR2021/001574 designating the United States, filed on Feb. 5, 2021 in the Korean Intellectual Property Receiving Office, and claiming priority to each of Korean Patent Application No. 10-2020-0014551 filed on Feb. 6, 2020, Korean Patent Application No. 10-2020-0015954 filed on Feb. 10, 2020, and Korean Patent Application No. 10-2020-0016605 filed on Feb. 11, 2020, the disclosures of which are all hereby incorporated herein by reference for all purposes as if fully set forth herein.

TECHNICAL FIELD

Various embodiments disclosed herein relate to an electronic device including a display.

BACKGROUND

An electronic device such as a smartphone or a tablet PC may include a display. The electronic device may display a variety of content such as text, images, and icons through the display. The electronic device may drive the display at a specified refresh rate (e.g., 60 Hz or 120 Hz). When the refresh rate (e.g., 60 Hz or 120 Hz) is increased, a unit time for displaying one frame may be shortened, and a more natural screen transition may be provided to a user.

An electronic device according to the prior art sets the length of a vertical blank (sum of vertical back porch (VBP) and vertical front porch (VFP)) to be long at a low refresh rate (e.g., 60 Hz), and then maintains the length of the vertical blank at a high refresh rate (e.g., 120 Hz). In this case, 1H time (one Horizontal time) may be reduced, and abnormal phenomena such as screens cracking and stains may occur due to insufficient scan on time for driving the display panel.

SUMMARY

An electronic device includes a display panel, a display driver IC (integrated circuit) and a processor, wherein the display driver IC may set an output time (horizontal time) of one of lines constituting the display panel to a first time period, set a number of vertical blank lines for the display panel to a first number, drive the display panel at a first refresh rate corresponding to the first time period and the first number of the vertical blank lines, receive a control signal for changing from the first refresh rate to a second refresh rate from the processor, and set the output time to a second time period or set the number of the vertical blank lines to a second number and drive the display panel based on the control signal, wherein the display panel is driven at a second refresh rate while the second time period and the second number of vertical blank lines are being set, the first time period is different from the second time period, and the first number is different from the second number.

The electronic device according to various embodiments disclosed herein may differently set the number of vertical blanks or 1H time (one horizontal time) for each refresh rate. Through this, it is possible to prevent or reduce occurrence of abnormal phenomena such as screens cracking and stains due to insufficient scan on time to drive the display panel.

An electronic device according to various embodiments disclosed herein may first change one of the number of vertical blanks or 1H time (one horizontal time) and additionally change the other to change a refresh rate (60 Hz). Through this, the electronic device may prevent or reduce screen abnormalities while saving power.

BRIEF DESCRIPTION OF DRAWINGS

The above and other aspects, features, and advantages of certain example embodiments of the present disclosure will be more apparent from the following detailed description, taken in conjunction with the accompanying drawings, in which.

In the description of the drawings, the same or similar reference numerals may be used for the same or similar components.

DETAILED DESCRIPTION

Figure 1:
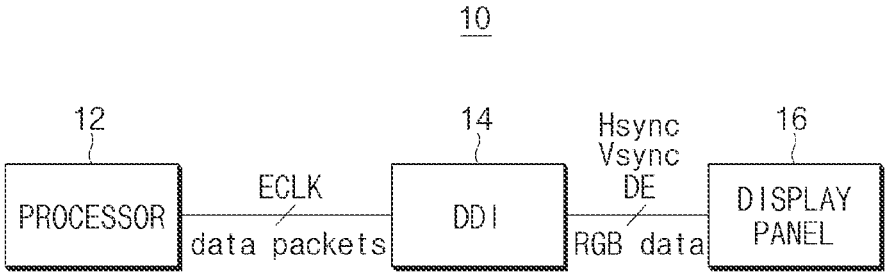
FIG. 1 is a block diagram of an electronic device according to various example embodiments.

Hereinafter, various embodiments of the disclosure may be described with reference to accompanying drawings. However, this is not intended to limit the technology described herein to specific embodiments, and those of ordinary skill in the art will recognize that modifications, equivalents, and/or alternatives on the various embodiments described herein can be variously made without departing from the scope and spirit of the disclosure. With regard to description of drawings, similar components may be marked by similar reference numerals.

FIG. 1 is a block diagram of an electronic device according to various embodiments.

Referring to FIG. 1, an electronic device 10 may include a processor (or an application processor (AP), a communication processor (CP), a sensor hub or a module including a touch panel circuit (e.g., TSP IC), or a micro controller unit (MCU)), a display driver integrated circuit (hereinafter referred to as 'DDI') 14, and a display panel 16. Each "processor" herein, and each "controller" herein, comprises processing circuitry.

The processor 12 may control overall operation of the electronic device 10 and may control input/output of data packets having display data according to clocks ECLK. Here, the data packets may include display data (e.g., RGB data), a horizontal synchronization signal (e.g., Hsync), a vertical synchronization signal (e.g., Vsync), and/or a data enable signal (e.g., data enable; DE).

According to various embodiments, the processor 12 may transmit a control signal related to a change of the refresh rate to the DDI 14. The DDI 14 may display data received from the processor 12 or image data stored in an internal graphic memory (e.g., GRAM) on the display panel 16 in response to the control signal.

According to various embodiments, the processor 12 may be a touch screen panel integrated circuit (e.g., a TSP IC). When the DDI 14 is in a PSR (panel self-refresh) operation state, the touch screen panel integrated circuit (e.g., TSP IC) may transmit a control signal for changing a refresh rate to the DDI 14 for smooth movement of an image (e.g., cursor image) by input of an electronic pen (e.g., touch input or hovering input). The DDI 14 may display the cursor image at the changed refresh rate in response to the control signal. In this case, the application processor AP may be maintained in a sleep state.

The DDI 14 may receive data packets from the processor 12 through an interface, and output a horizontal synchronization signal (Hsync), a vertical synchronization signal (Vsync), a data enable signal (DE), display data (RGB Data) and/or a clock signal. For example, the clock signal may be a clock (e.g., ECLK) input from the AP 12.

According to an embodiment, the AP 12 and/or the DDI 14 may control various interfaces. For example, the interface may be an interface (serial interface) such as a mobile industry processor interface (MIPI), a mobile display digital interface (MDDI), a compact display port (CDP), a mobile pixel link (MPL), a current mode advanced differential signaling (CMADS), and a Serial Peripheral Interface (SPI), or I2C (Inter-Integrated Circuit). Hereinafter, for convenience of description, it will be assumed that the DDI 14 performs interfacing according to the MIPI method.

The DDI 14 may include a graphic memory (hereinafter, referred to as 'GRAM'). The DDI 14 may reduce current consumption and reduce the load on the processor 12 by using the GRAM. The GRAM may write display data input from the processor 12 and output written data through a scan operation. In an embodiment, the GRAM may be implemented with a dual-port DRAM.

According to various embodiments, the processor 12 may not transmit a control signal related to the change of the refresh rate to the DDI 14. The DDI 14 may display image data stored in the internal GRAM on the display panel 16 at a changed refresh rate according to a specified condition. The condition may be a condition related to the luminance or OPR (on pixel ratio; ratio of turned-on pixels to all pixels of the display panel 16) of the display panel 16 while image data is not being transmitted from the processor 12 for a certain period of time. For example, when the luminance of the display panel 16 is less than or equal to a preset value, the refresh rate may be increased.

The display panel 16 may display data in units of frames under the control of the DDI 14. For example, the display panel 16 may include any one of an organic light emitting diode (OLED) panel, a liquid crystal display (LCD) panel, a plasma display panel (PDP), an electrophoretic display panel, and an electrowetting display panel.

Figure 2:
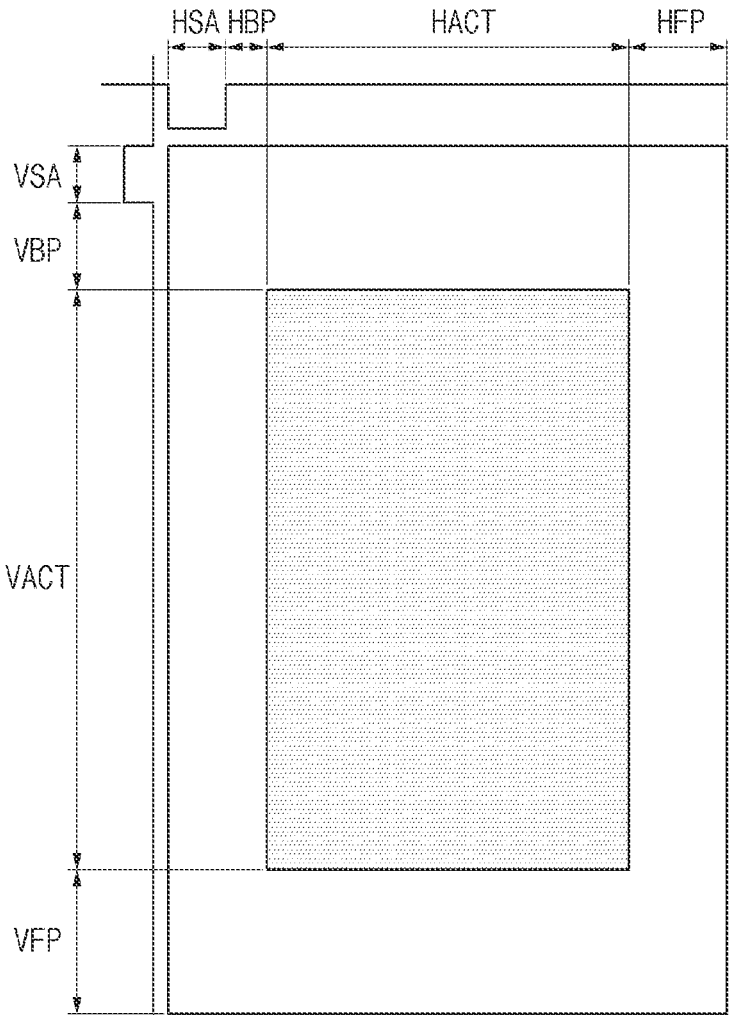
FIG. 2 is a configuration diagram illustrating a signal for driving a display panel according to an example embodiment.

FIG. 2 is a configuration diagram illustrating a signal for driving a display panel according to an embodiment. The configuration diagram of FIG. 2 may correspond to one frame output through a display panel. FIG. 2 is merely an example and the disclosure is not limited thereto.

Referring to FIG. 2, a signal for driving the display panel 16 may include a horizontal sync active (HSA) period, a horizontal back porch (HBP), a horizontal active (HACT) period, and/or a horizontal front porch (HFP), which are operable in a horizontal direction based on a horizontal sync signal (Hsync).

A signal for driving the display panel 16 may include a vertical sync active (VSA) period, a vertical back porch (VBP), a vertical active (VACT) period, and/or a vertical front porch (VFP), which are operable in a vertical direction based on a vertical sync signal (Vsync).

According to various embodiments, the processor 12 or the DDI 14 may change the number of vertical blanks (sum of vertical front porch VFP and vertical back porch VBP) according to a refresh rate (or frame rate) or 1H time.

Figure 3:
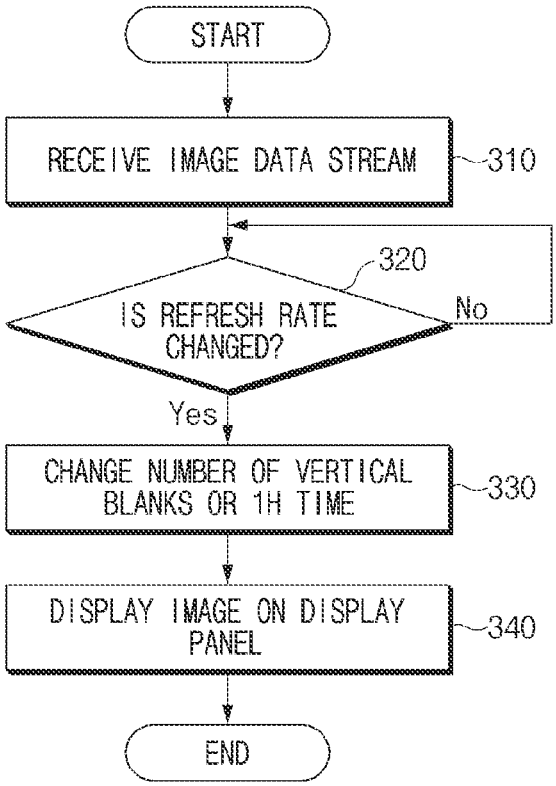
FIG. 3 is a flowchart illustrating a screen display method according to various example embodiments.

FIG. 3 is a flowchart illustrating a screen display method according to various embodiments.

Referring to FIG. 3, in operation 310, the DDI 14 may receive an image data stream from the processor 12 (which includes processing circuitry). The DDI 14 may display an image by driving the display panel 16 based on the received image data stream.

According to an embodiment, operation 310 may be omitted. For example, the DDI 14 may drive the display panel 16 based on image data stored in the internal graphic memory (GRAM) to display an image without receiving a separate image data stream from the processor 12. As another example, the DDI 14 may drive the display panel 16 based on image data which has been applied to the display panel 16 (image data stored (or remaining) in transistors constituting the display panel 16) to display an image without receiving a separate image data stream from the processor 12.

According to various embodiments, the DDI 14 may receive a control signal related to a refresh rate for driving the display panel 16 from the processor 12. The DDI 14 may set the number of vertical blanks (sum of vertical front porch VFP and vertical back porch VBP) for driving the display panel 16 or the 1H time based on the received control signal and drive the display panel 16 according to the set value. For example, when the refresh rate is set to 60 Hz for the display panel 16 with a resolution of 2400*1080 (16.67 ms per frame), the DDI 14 may set the number of vertical blanks to 268 (16 VFPs+252 VBPs), and set the 1H time to 6.25 μs (16.67 ms/2668).

In operation 320, the DDI 14 may determine whether a signal for changing the refresh rate of the display panel 16 is received from the processor 12. When there is no signal for changing the refresh rate, the DDI 14 may maintain the existing number of vertical blanks (sum of vertical front porch VFP and vertical back porch VBP) or the 1H time.

In operation 330, when receiving a signal for changing the refresh rate of the display panel 16 from the processor 12, the DDI 14 may change the number of vertical blanks (sum of vertical front porch VFP and vertical back porch VBP) or the 1H time.

According to an embodiment, in response to the signal, the DDI 14 may simultaneously change the number of vertical blanks (sum of vertical front porch VFP and vertical back porch VBP) or the 1H time.

According to another embodiment, in response to the signal, the DDI 14 may first change the number of vertical blanks (sum of vertical front porch VFP and vertical back porch VBP) and then change the 1H time.

According to another embodiment, in response to the signal, the DDI 14 may first change the 1H time and then change the number of vertical blanks (sum of vertical front porch VFP and vertical back porch VBP).

In operation 340, the DDI 14 may display an image on the display panel 16, based on the changed number of vertical blanks (sum of vertical front porch VFP and vertical back porch VBP) and the changed 1H time.

Figure 4:
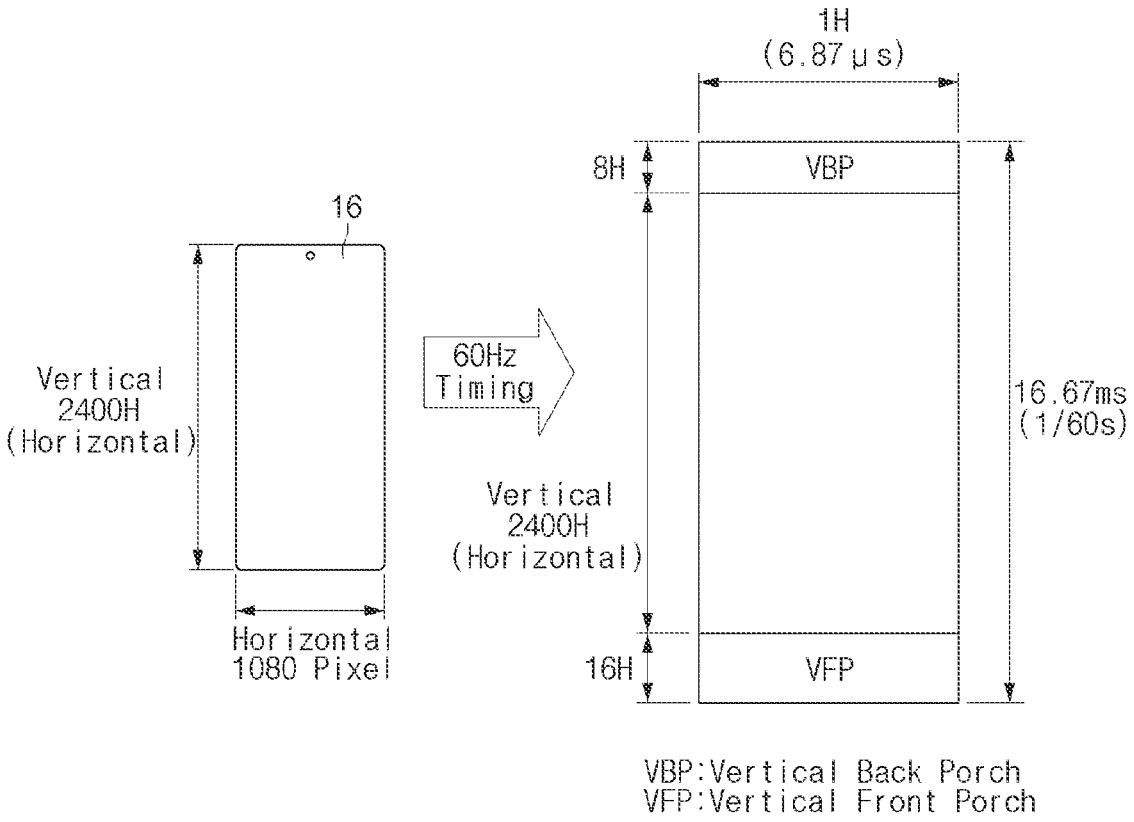
FIG. 4 is a diagram illustrating screen resolution and timing according to various example embodiments.

FIG. 4 is a diagram illustrating screen resolution and timing according to various embodiments. FIG. 4 illustrates an example of an operation at a refresh rate of 60 Hz, but the disclosure is not limited thereto.

Referring to FIG. 4, the display panel 16 may have a specified resolution. For example, the display panel 16 may have a resolution of 2400*1080. Hereinafter, description will be given while focusing on a case in which the display panel 16 has a resolution of 2400*1080, but the disclosure is not limited thereto.

When the display panel 16 has a resolution of 2400*1080, the timing of the display panel 16 may include a total of 2424 H lines, including 24 vertical blanks (16 VFPs+8 VBPs). When 2424 H lines are output at a refresh rate of 60 Hz, 2424 H lines may be output at 6.87 μs per one horizontal line (1080 Pixel) (16.67 ms/2424 H lines). In this case, a scan frequency may be 145.4 KHz (1/6.87 μs).

According to various embodiments, the processor 12 or the DDI 14 may change the number of vertical blanks (sum of vertical front porch VFP and vertical back porch VBP) according to the refresh rate.

For example, when the refresh rate is 60 Hz, the number of vertical blanks may be set to 268 (16 VFPs+252 VBPs) other than 24 (16 VFPs+8 VBPs). On the other hand, when the refresh rate is 120 Hz, the number of vertical blanks may be set to 24 (16 VFPs+8 VBPs) (see FIG. 5).

According to various embodiments, the processor 12 may transmit a signal for changing a refresh rate to the DDI 14. The DDI 14 may change a 1H time in response to the signal. In this case, the number of vertical blanks may be maintained or changed. According to an embodiment, the DDI 14 may change 1H time and the number of vertical blanks at the same time. For example, the DDI 14 may simultaneously change the 1H (Horizontal) time and the number of vertical blanks according to the same vertical synchronization signal Vsync.

According to an embodiment, the DDI 14 may change 1H time and the number of vertical blanks individually. For example, the DDI 14 may first change the 1H (Horizontal) time, and change the number of vertical blanks after the 1H time is changed. On the other hand, the DDI 14 may first change the number of vertical blanks, and change the 1H (Horizontal) time after the number of vertical blanks has been changed.

According to various embodiments, the processor 12 or the DDI 14 may set a refresh rate for driving for each application. For example, a first application (e.g., a message app) may be fixedly set to have at a relatively low first refresh rate (e.g., 60 Hz), and a second application (e.g., a game app) may be fixedly set to a relatively high second refresh rate (120 Hz). For another example, the processor 12 or the DDI 14 may perform settings such that a refresh rate is changed according to a specified condition (e.g., communication environment, whether an option is executed, whether a user input is generated). The processor 12 or the DDI 14 may change the 1H (Horizontal) time or change the number of vertical blanks in response to the changed refresh rate.

According to various embodiments, the processor 12 or the DDI 14 may change and set a refresh rate while driving one application. For example, the DDI 14 may change the refresh rate in a panel self refresh (PSR) state in which the image is a still image. When an electronic pen input occurs while panel self refresh (PSR) is being activated or when the DDI 14 performs self-drawing on a cursor during hovering, the refresh rate may be changed for smooth movement of the cursor. The DDI 14 may change the 1H (Horizontal) time or change the number of vertical blanks in response to the changed refresh rate.

According to an embodiment, the processor 12 or the DDI 14 may change the scan frequency according to a specified condition while the refresh rate is set to be fixed. For example, the processor 12 or the DDI 14 may change the refresh rate to 66 Hz to prevent or reduce signal interference when the processor 12 or the DDI 14 enters a wireless charging state while driving an application in which the refresh rate is fixedly set to 60 Hz.

According to various embodiments, the processor 12 or the DDI 14 may change the number of vertical blanks (sum of VFP and VBP) and maintain the 1H time which is a basic unit when the refresh rate is changed within a specified range (e.g., from 60 Hz to 66 Hz). In addition, the processor 12 or the DDI 14 may maintain the number of vertical blanks (sum of VFP and VBP) and change the 1H time which is a basic unit when the refresh rate is changed out of a specified range (see FIGS. 6 and 7).

Although it is exemplarily shown in FIG. 4 that the display panel 16 has a resolution of 2400*1080, the disclosure is not limited thereto. For example, the display panel 16 may have a resolution of 3200*1440.

Figure 5:
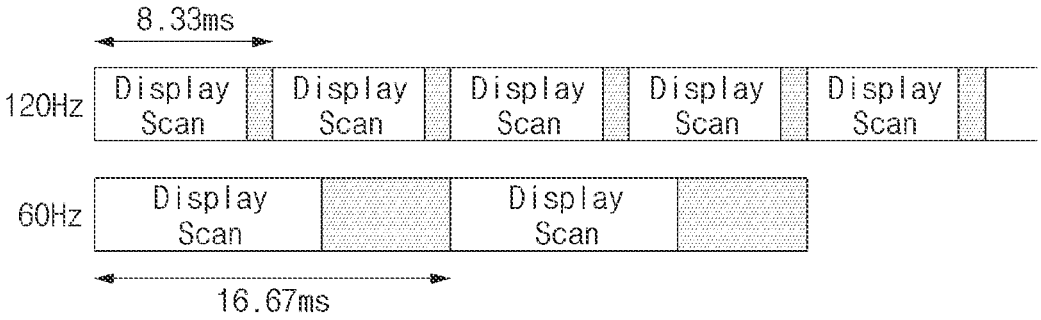
FIG. 5 is a diagram illustrating a screen display method of differently setting the number of vertical blanks according to refresh rates according to various example embodiments.

FIG. 5 is a diagram illustrating a screen display method of differently setting the number of vertical blanks or 1H time according to refresh rates according to various embodiments.

Referring to FIG. 5, the processor 12 or the DDI 14 may differently set the number of vertical blanks or 1H time for each refresh rate. According to an embodiment, the processor 12 may transmit a signal for changing a refresh rate to the DDI 14 when a running application is changed. The DDI 14 may change the number of vertical blanks or 1H time in response to the signal.

According to an embodiment, the processor 12 or the DDI 14 may perform settings to increase the number of vertical blanks at a relatively low first refresh rate, and decrease the number of vertical blanks at a relatively high second refresh rate.

For example, when the refresh rate is 60 Hz (16.67 ms per frame), the processor 12 or the DDI 14 may set the number of vertical blanks to 268 (16 VFPs+252 VBPs). In this case, 1H time may be set to 6.25 μs (16.67 ms/2668).

As another example, when the refresh rate is 120 Hz (8.33 ms per frame), the number of vertical blanks may be set to 24 (16 VFPs+8 VBPs). In this case, 1H time may be set to 3.43 μs (8.33 ms/2424).

When the number of vertical blanks is maintained to be 268 (16 VFPs+252 VBPs) like the case of 60 Hz in a case where the refresh rate is 120 Hz, 1H time may be 3.12 μs (8.33 ms/2668). In this case, abnormal phenomena such as screen cracks and stains may occur due to an insufficient charging time (Scan on Time) for driving of the display panel 16 with respect to the display panel 16. On the other hand, when the number of vertical blanks is set to be changed to 24 (16 VFPs+8 VBPs) as shown in FIG. 5 in a state where the refresh rate is 120 Hz, the charging time (Scan on Time) for the display panel 16 may be secured to prevent or reduce abnormal phenomena such as screen cracks and stains.

According to various embodiments, the processor 12 or the DDI 14 may reflect a change in the number of vertical blanks in the same vertical synchronization signal VSync or in the time between frames to apply the change to the next frame. In this case, the screen display may not be affected or be rarely affected.

According to various embodiments, the DDI 14 may change the 1H time in association with the number of vertical blanks or set the 1H time separately. For example, when the refresh rate is 60 Hz (16.67 ms per frame), the DDI 14 may set the number of vertical blanks to 268 (16 VFPs+252 VBPs), and set the 1H time to 6.25 μs (16.67 ms/2668) in correspondence to the number of vertical blanks. Alternatively, the DDI 14 may set the 1H time to a time period shorter than 6.25 μs.

As another example, when the refresh rate is 120 H (8.33 ms per frame), the DDI 14 may set the number of vertical blanks to 24 (16 VFPs+8 VBPs), and set the 1H time to 3.43 μs (8.33 ms/2424) in correspondence to the number of vertical blanks. Alternatively, the DDI 14 may set the 1H time to a time period longer than 3.43 μs.

Although the description has been given with reference to FIG. 5 while focusing on a case in which the refresh rate is 60 Hz or 120 Hz, the disclosure is not limited thereto. For example, when the refresh rate is 90 Hz (11.11 ms per frame), the processor 12 or the DDI 14 may set the number of vertical blanks to 268 (16 VFPs+252 VBPs). In this case, the 1H time may be set to 4.16 μs (11.11 ms/2668).

As another example, when the refresh rate is 90 Hz (11.11 ms per frame), the number of vertical blanks may be set to 24 (16 VFPs+8 VBPs). In this case, the 1H time may be set to 4.58 μs (11.11 ms/2424).

Figure 6:
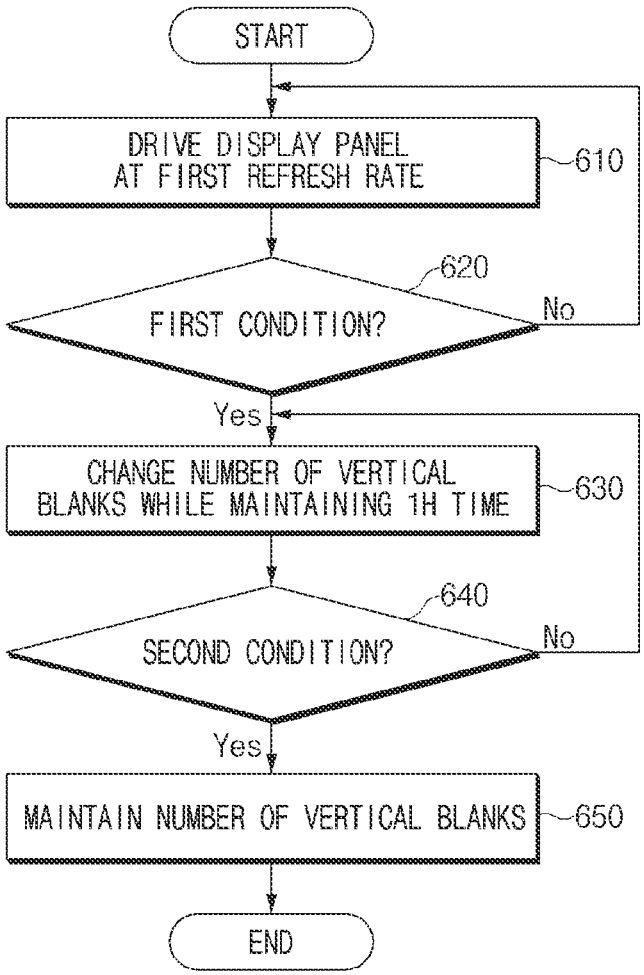
FIG. 6 is a flowchart illustrating a screen display method according to various example embodiments.

FIG. 6 is a flowchart illustrating a screen display method according to various embodiments.

Referring to FIG. 6, in operation 610, the processor 12 or the DDI 14 may drive the display panel 16 at a first refresh rate. For example, the processor 12 or the DDI 14 may drive the display panel 16 at a first refresh rate (e.g., 60 Hz) according to default settings of an application.

In operation 620, the processor 12 or the DDI 14 may determine whether a first condition occurs in which a refresh rate is required to be changed within a specified first range (e.g., a range of 30 Hz). For example, the first condition may be a condition that the electronic device 10 is charged through a wireless charging device in a state in which the same application is being executed.

In operation 630, when the first condition is satisfied, the processor 12 or the DDI 14 may change the number of vertical blanks (sum of VFP and VBP) while maintaining 1H time. For example, the processor 12 or DDI 14 may fix the 1H time to 6.25 μs and change the number of vertical blanks from 268 (8+252) to 24 (8+16) (for resolution of 2400*1080) when the refresh rate is changed from 60 Hz to 66 Hz.

In operation 640, the processor 12 or the DDI 14 may determine whether a second condition occurs in which a refresh rate is required to be changed out of a specified first range (e.g., a range of 30 Hz). For example, the second condition may be a change in a running application (e.g., execution of a game app) or a change in an option of a running application (e.g., when a graphic option is changed such that graphic quality is high during game execution).

In operation 650, when the second condition is satisfied, the processor 12 or the DDI 14 may change 1H time while maintaining the number of vertical blanks (sum of VFP and VBP). For example, the processor 12 or the DDI 14 may maintain the number of vertical blanks to be 24 (8+16) when the refresh rate is changed from 66 Hz to 120 Hz. The 1H time may be changed from 6.25 μs to 3.43 μs (for resolution of 2400*1080).

According to various embodiments, when the second condition requiring a change in the refresh rate out of the first range (e.g., the range of 30 Hz) first occurs regardless of the first condition, the processor 12 or the DDI 14 may operate according to the number of vertical blanks set for each refresh rate (see FIG. 5).

Figure 7:
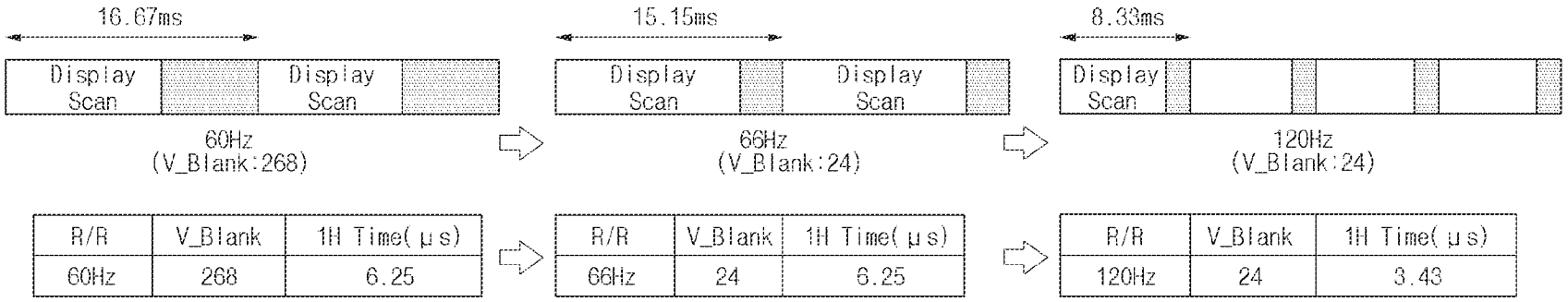
FIG. 7 shows examples for the screen display method of FIG. 5 according to various example embodiments.

FIG. 7 shows examples for the screen display method of FIG. 5 according to various embodiments;

Referring to FIG. 7, the processor 12 or the DDI 14 may drive the display panel 16 while changing a refresh rate according to various conditions.

For example, the processor 12 or the DDI 14 may drive the display panel 16 at a first refresh rate (e.g., 60 Hz) (or the lowest refresh rate) according to default settings of an application. When a first type of application set to operate at the first refresh rate (e.g., 60 Hz) is being executed alone, the processor 12 or the DDI 14 may drive the display panel 16 at the first refresh rate (e.g., 60 Hz) (16.67 ms per frame).

For example, when driving the display panel 16 having a resolution of 2400*1080, the number of vertical blanks may be set to 268 (16 VFPs+252 VBPs) at the first refresh rate (60 Hz). 1H time may be set to 6.25 μs (16.67 ms/2668).

The processor 12 or the DDI 14 may determine whether a first condition occurs in which a refresh rate is required to be changed within a specified first range (e.g., within a range of 30 Hz). For example, the first condition may be a condition that charging is performed through a wireless charging device in a state in which the same application is being executed.

When the first condition is satisfied, the processor 12 or the DDI 14 may change the number of vertical blanks (VFPs and VBPs) while maintaining 1H time.

For example, when the first refresh rate (60 Hz) is changed to the second refresh rate (66 Hz) (changed from 16.67 ms per frame to 15.15 ms per frame) in a case where the processor 12 or the DDI 14 drives the display panel 16 having a resolution of 2400*1080, the number of vertical blanks may be changed from 268 (16 VFPs+252 VBPs) to 24 (16 VFPs+8 VBPs). 1H time may be maintained to be 6.25 μs (15.15 ms/2424).

The processor 12 or the DDI 14 may determine whether a second condition occurs in which a refresh rate is required to be changed out of a specified first range (e.g., a range of 30 Hz). For example, the second condition may be a change in a running application (e.g., execution of a game app) or a change in an option of a running application (e.g., when a graphic option is changed such that graphic quality is high during game execution).

When the second condition is satisfied, the processor 12 or the DDI 14 may change 1H time while maintaining the number of vertical blanks (sum of VFP and VBP).

For example, when the second refresh rate (66 Hz) is changed to the third refresh rate (80 Hz) (changed from 15.15 ms per frame to 12.50 ms per frame) in a case where the processor 12 or the DDI 14 drives the display panel 16 having a resolution of 2400*1080, the number of vertical blanks may be maintained to be 24 (16 VFPs+8 VBPs). In this case, 1H time may be changed to 5.16 μs (12.50 ms/2424). The processor 12 or the DDI 14 may change 1H time while maintaining vertical blanking until a maximum refresh rate (e.g., 120 Hz) for driving the display panel 16 has been reached. Each of the processor 12 and the DDI 14 comprise circuitry.

According to various embodiments, the processor 12 or the DDI 14 may change the refresh rate (e.g., from 60 Hz to 66 Hz) by changing the number of vertical blanks (sum of VFP and VBP) when driving the display panel 16 at the minimum refresh rate (e.g., 60 Hz) for driving the display panel 16. When the number of vertical blanks (sum of VFP and VBP) set for the changed refresh rate (e.g., 66 Hz) is equal to the number of vertical blanks (sum of VFP and VBP) (e.g., 24) set for the maximum refresh rate (120 Hz) for driving the display panel 16, then the processor 12 or the DDI 14 may change the refresh rate (e.g., change from 66 Hz to 80 Hz) while maintaining the number of vertical blanks (sum of VFP and VBP) (e.g., 24).

Each embodiment herein may be used in combination with any other embodiment herein.

Figure 8:
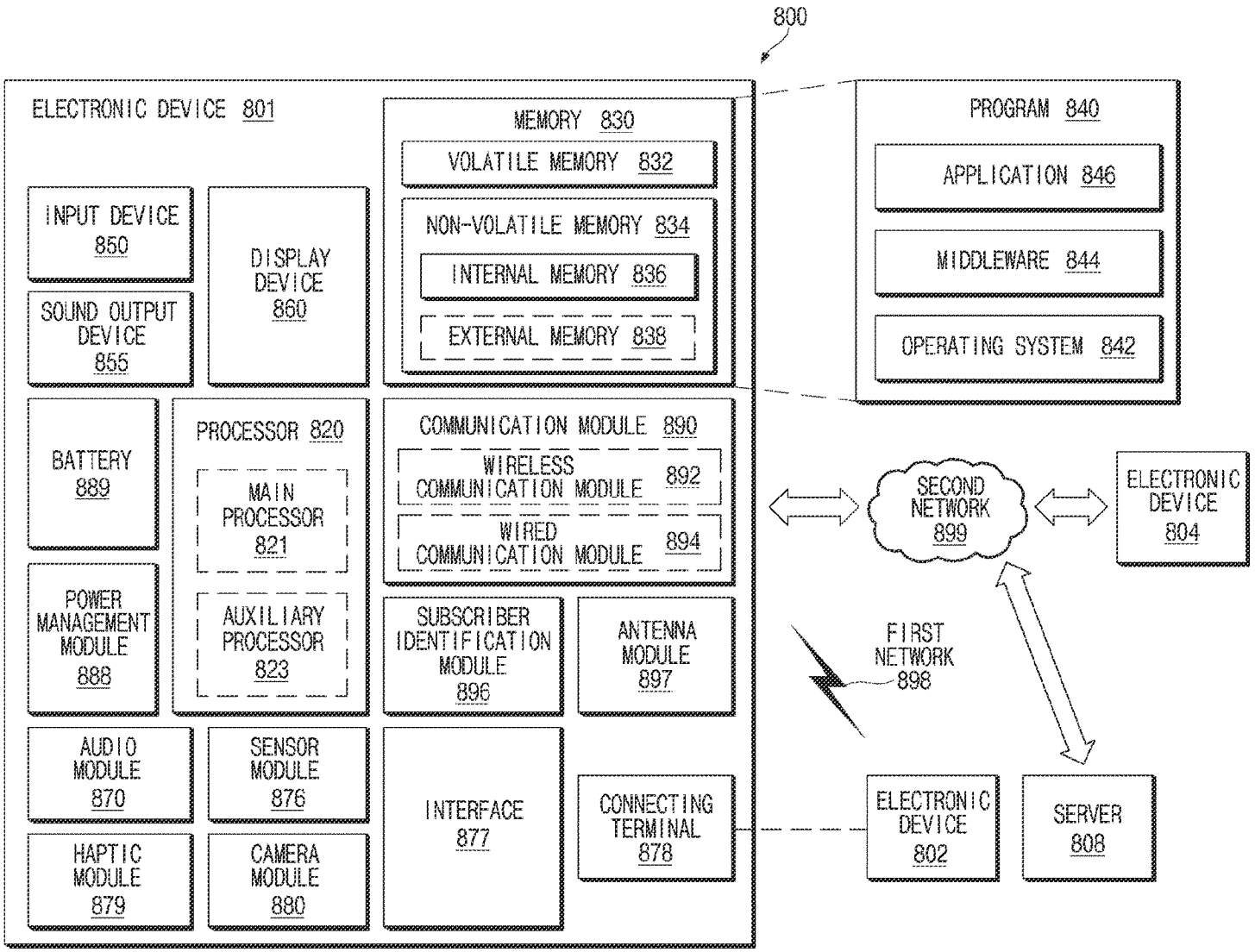
FIG. 8 is an electronic device in a network environment, according to various example embodiments.

FIG. 8 is a block diagram illustrating an electronic device 801 in a network environment 800 according to various embodiments. Referring to FIG. 8, the electronic device 801 in the network environment 800 may communicate with an electronic device 802 via a first network 898 (e.g., a short-range wireless communication network), or an electronic device 804 or a server 808 via a second network 899 (e.g., a long-range wireless communication network). According to an embodiment, the electronic device 801 may communicate with the electronic device 804 via the server 808. According to an embodiment, the electronic device 801 may include a processor 820, memory 830, an input device 850, a sound output device 855, a display device 860, an audio module 870, a sensor module 876, an interface 877, a haptic module 879, a camera module 880, a power management module 888, a battery 889, a communication module 890, a subscriber identification module (SIM) 896, or an antenna module 897. In some embodiments, at least one (e.g., the display device 860 or the camera module 880) of the components may be omitted from the electronic device 801, or one or more other components may be added in the electronic device 801. In some embodiments, some of the components may be implemented as single integrated circuitry. For example, the sensor module 876 (e.g., a fingerprint sensor, an iris sensor, or an illuminance sensor) may be implemented as embedded in the display device 860 (e.g., a display).

The processor 820 may execute, for example, software (e.g., a program 840) to control at least one other component (e.g., a hardware or software component) of the electronic device 801 coupled with the processor 820, and may perform various data processing or computation. According to one embodiment, as at least part of the data processing or computation, the processor 820 may load a command or data received from another component (e.g., the sensor module 876 or the communication module 890) in volatile memory 832, process the command or the data stored in the volatile memory 832, and store resulting data in non-volatile memory 834. According to an embodiment, the processor 820 may include a main processor 821 (e.g., a central processing unit (CPU) or an application processor (AP)), and an auxiliary processor 823 (e.g., a graphics processing unit (GPU), an image signal processor (ISP), a sensor hub processor, or a communication processor (CP)) that is operable independently from, or in conjunction with, the main processor 821. Additionally or alternatively, the auxiliary processor 823 may be adapted to consume less power than the main processor 821, or to be specific to a specified function. The auxiliary processor 823 may be implemented as separate from, or as part of the main processor 821.

The auxiliary processor 823 may control at least some of functions or states related to at least one component (e.g., the display device 860, the sensor module 876, or the communication module 890) among the components of the electronic device 801, instead of the main processor 821 while the main processor 821 is in an inactive (e.g., sleep) state, or together with the main processor 821 while the main processor 821 is in an active state (e.g., executing an application). According to an embodiment, the auxiliary processor 823 (e.g., an image signal processor or a communication processor) may be implemented as part of another component (e.g., the camera module 880 or the communication module 890) functionally related to the auxiliary processor 823.

The memory 830 may store various data used by at least one component (e.g., the processor 820 or the sensor module 876) of the electronic device 801. The various data may include, for example, software (e.g., the program 840) and input data or output data for a command related thereto. The memory 830 may include the volatile memory 832 or the non-volatile memory 834.

The program 840 may be stored in the memory 830 as software, and may include, for example, an operating system (OS) 842, middleware 844, or an application 846.

The input device 850 may receive a command or data to be used by other component (e.g., the processor 820) of the electronic device 801, from the outside (e.g., a user) of the electronic device 801. The input device 850 may include, for example, a microphone, a mouse, a keyboard, or a digital pen (e.g., a stylus pen).

The sound output device 855 may output sound signals to the outside of the electronic device 801. The sound output device 855 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 860 may visually provide information to the outside (e.g., a user) of the electronic device 801. The display device 860 may include, for example, a display, a hologram device, or a projector and control circuitry to control a corresponding one of the display, hologram device, and projector. According to an embodiment, the display device 860 may include touch circuitry adapted to detect a touch, or sensor circuitry (e.g., a pressure sensor) adapted to measure the intensity of force incurred by the touch.

The audio module 870 may convert a sound into an electrical signal and vice versa. According to an embodiment, the audio module 870 may obtain the sound via the input device 850, or output the sound via the sound output device 855 or a headphone of an external electronic device (e.g., an electronic device 802) directly (e.g., wiredly) or wirelessly coupled with the electronic device 801.

The sensor module 876 may detect an operational state (e.g., power or temperature) of the electronic device 801 or an environmental state (e.g., a state of a user) external to the electronic device 801, and then generate an electrical signal or data value corresponding to the detected state. According to an embodiment, the sensor module 876 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 877 may support one or more specified protocols to be used for the electronic device 801 to be coupled with the external electronic device (e.g., the electronic device 802) directly (e.g., wiredly) or wirelessly. According to an embodiment, the interface 877 may include, for example, a high definition multimedia interface (HDMI), a universal serial bus (USB) interface, a secure digital (SD) card interface, or an audio interface.

A connecting terminal 878 may include a connector via which the electronic device 801 may be physically connected with the external electronic device (e.g., the electronic device 802). According to an embodiment, the connecting terminal 878 may include, for example, a HDMI connector, a USB connector, a SD card connector, or an audio connector (e.g., a headphone connector).

The haptic module 879 may convert an electrical signal into a mechanical stimulus (e.g., a vibration or a movement) or electrical stimulus which may be recognized by a user via his tactile sensation or kinesthetic sensation. According to an embodiment, the haptic module 879 may include, for example, a motor, a piezoelectric element, or an electric stimulator.

The camera module 880 may capture a still image or moving images. According to an embodiment, the camera module 880 may include one or more lenses, image sensors, image signal processors, or flashes.

The power management module 888 may manage power supplied to the electronic device 801. According to one embodiment, the power management module 888 may be implemented as at least part of, for example, a power management integrated circuit (PMIC).

The battery 889 may supply power to at least one component of the electronic device 801. According to an embodiment, the battery 889 may include, for example, a primary cell which is not rechargeable, a secondary cell which is rechargeable, or a fuel cell.

The communication module 890 may support establishing a direct (e.g., wired) communication channel or a wireless communication channel between the electronic device 801 and the external electronic device (e.g., the electronic device 802, the electronic device 804, or the server 808) and performing communication via the established communication channel. The communication module 890 may include one or more communication processors that are operable independently from the processor 820 (e.g., the application processor (AP)) and supports a direct (e.g., wired) communication or a wireless communication. According to an embodiment, the communication module 890 may include a wireless communication module 892 (e.g., a cellular communication module, a short-range wireless communication module, or a global navigation satellite system (GNSS) communication module) or a wired communication module 894 (e.g., a local area network (LAN) communication module or a power line communication (PLC) module). A corresponding one of these communication modules may communicate with the external electronic device via the first network 898 (e.g., a short-range communication network, such as Bluetooth™, wireless-fidelity (Wi-Fi) direct, or infrared data association (IrDA)) or the second network 899 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 892 may identify and authenticate the electronic device 801 in a communication network, such as the first network 898 or the second network 899, using subscriber information (e.g., international mobile subscriber identity (IMSI)) stored in the subscriber identification module 896.

The antenna module 897 may transmit or receive a signal or power to or from the outside (e.g., the external electronic device) of the electronic device 801. According to an embodiment, the antenna module 897 may include an antenna including a radiating element composed of a conductive material or a conductive pattern formed in or on a substrate (e.g., PCB). According to an embodiment, the antenna module 897 may include a plurality of antennas. In such a case, at least one antenna appropriate for a communication scheme used in the communication network, such as the first network 898 or the second network 899, may be selected, for example, by the communication module 890 (e.g., the wireless communication module 892) from the plurality of antennas. The signal or the power may then be transmitted or received between the communication module 890 and the external electronic device via the selected at least one antenna. According to an embodiment, another component (e.g., a radio frequency integrated circuit (RFIC)) other than the radiating element may be additionally formed as part of the antenna module 897.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 801 and the external electronic device 804 via the server 808 coupled with the second network 899. Each of the electronic devices 802 and 804 may be a device of a same type as, or a different type, from the electronic device 801. According to an embodiment, all or some of operations to be executed at the electronic device 801 may be executed at one or more of the external electronic devices 802, 804, or 808. For example, if the electronic device 801 should perform a function or a service automatically, or in response to a request from a user or another device, the electronic device 801, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 801. The electronic device 801 may provide the outcome, with or without further processing of the outcome, as at least part of a reply to the request. To that end, a cloud computing, distributed computing, or client-server computing technology may be used, for example.

Figure 9:
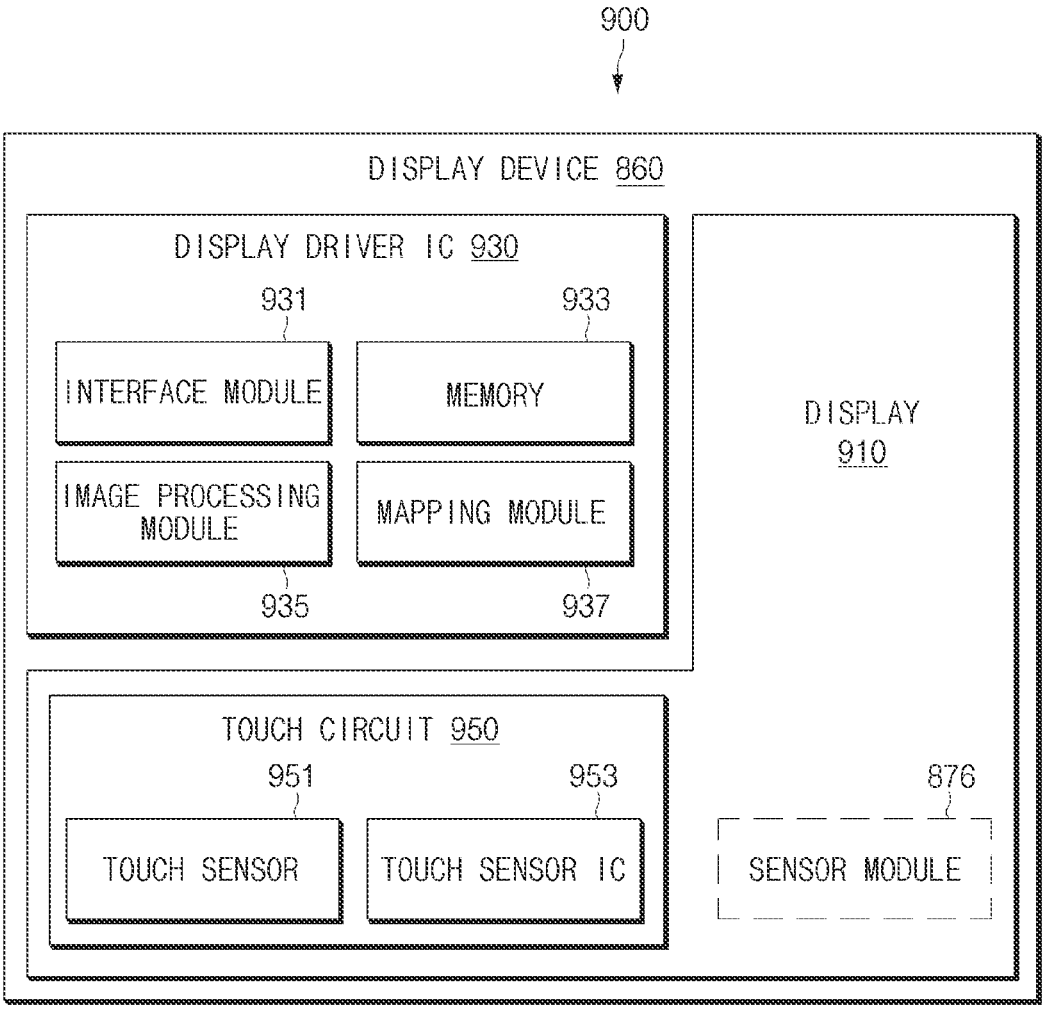
FIG. 9 is a block diagram of a display device according to various example embodiments.

FIG. 9 is a block diagram 900 illustrating the display device 860 according to various embodiments. Referring to FIG. 9, the display device 860 may include a display 910 and a display driver integrated circuit (DDI) 930 to control the display 910. The DDI 930 may include an interface module 931, memory 933 (e.g., buffer memory), an image processing module 935, or a mapping module 937. The DDI 930 may receive image information that contains image data or an image control signal corresponding to a command to control the image data from another component of the electronic device 801 via the interface module 931. For example, according to an embodiment, the image information may be received from the processor 820 (e.g., the main processor 821 (e.g., an application processor)) or the auxiliary processor 823 (e.g., a graphics processing unit) operated independently from the function of the main processor 821. The DDI 930 may communicate, for example, with touch circuitry 850 or the sensor module 876 via the interface module 931. The DDI 930 may also store at least part of the received image information in the memory 933, for example, on a frame by frame basis. The image processing module 935 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 910. The mapping module 937 may generate a voltage value or a current value corresponding to the image data pre-processed or post-processed by the image processing module 935. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 910 may be driven, for example, based at least in part on the voltage value or the current value such that visual information (e.g., a text, an image, or an icon) corresponding to the image data may be displayed via the display 910.

According to an embodiment, the display device 860 may further include the touch circuitry 950. The touch circuitry 950 may include a touch sensor 951 and a touch sensor IC 953 to control the touch sensor 951. The touch sensor IC 953 may control the touch sensor 951 to sense a touch input or a hovering input with respect to a certain position on the display 910. To achieve this, for example, the touch sensor 951 may detect (e.g., measure) a change in a signal (e.g., a voltage, a quantity of light, a resistance, or a quantity of one or more electric charges) corresponding to the certain position on the display 910. The touch circuitry 950 may provide input information (e.g., a position, an area, a pressure, or a time) indicative of the touch input or the hovering input detected via the touch sensor 951 to the processor 820. According to an embodiment, at least part (e.g., the touch sensor IC 953) of the touch circuitry 950 may be formed as part of the display 910 or the DDI 930, or as part of another component (e.g., the auxiliary processor 823) disposed outside the display device 860.

According to an embodiment, the display device 860 may further include at least one sensor (e.g., a fingerprint sensor, an iris sensor, a pressure sensor, or an illuminance sensor) of the sensor module 876 or a control circuit for the at least one sensor. In such a case, the at least one sensor or the control circuit for the at least one sensor may be embedded in one portion of a component (e.g., the display 910, the DDI 930, or the touch circuitry 850)) of the display device 860. For example, when the sensor module 876 embedded in the display device 860 includes a biometric sensor (e.g., a fingerprint sensor), the biometric sensor may obtain biometric information (e.g., a fingerprint image) corresponding to a touch input received via a portion of the display 910. As another example, when the sensor module 876 embedded in the display device 860 includes a pressure sensor, the pressure sensor may obtain pressure information corresponding to a touch input received via a partial or whole area of the display 910. According to an embodiment, the touch sensor 951 or the sensor module 876 may be disposed between pixels in a pixel layer of the display 910, or over or under the pixel layer.

According to various embodiments, an electronic device (e.g., the electronic device 10 of FIG. 1 or an electronic device 801 of FIG. 8) may include a display panel (e.g., the display panel 16 of FIG. 1 or a display device 860 of FIG. 8), a display driver IC (e.g., the DDI 14 of FIG. 1) that drives the display panel (e.g., the display panel 16 of FIG. 1 or the display device 860 of FIG. 8), and a processor (e.g., the processor 12 of FIG. 1 or a processor 820 of FIG. 8), wherein the display driver IC (e.g., the DDI 14 of FIG. 1) may set an output time (horizontal time) of one of lines constituting the display panel to a first time period, set a number of vertical blank lines for the display panel to a first number, drive the display panel at a first refresh rate corresponding to the first time period and the first number of the vertical blank lines, receive a control signal for changing from the first refresh rate to a second refresh rate from the processor, and set the output time to a second time period or set the number of the vertical blank lines to a second number and drive the display panel, wherein the display panel may be driven at the second refresh rate while the second time period and the second number of vertical blank lines is being set, wherein the first time period may be different from the second time period, and wherein the first number may be different from the second number.

According to various embodiments, the display driver IC (e.g., the DDI 14 of FIG. 1) may change from the first refresh rate to a third refresh rate between the first refresh rate and the second refresh rate based on the control signal, and change to the second refresh rate after having changed to the third refresh rate.

According to various embodiments, the display driver IC (e.g., the DDI 14 of FIG. 1) may perform setting to change at least one of the first time period and the first number to a third time period or a third number respectively for change to the third refresh rate, wherein the third time period may be a value between the first time period and the second time period, and the third number may be a value between the first number and the second number.

According to various embodiments, the processor (e.g., the processor 12 of FIG. 1 or the processor 820 of FIG. 8) may be one of an application processor (e.g., the processor 12 of FIG. 1 or the processor 820 of FIG. 8) (AP), a communication processor (e.g., the processor 12 of FIG. 1 or the processor 820 of FIG. 8) (CP), a sensor hub or a touch panel circuit, or a module including a micro controller unit (MCU).

According to various embodiments, information on the second time period and the second number is received from the processor (e.g., the processor 12 of FIG. 1 or the processor 820 of FIG. 8) or stored in the display driver IC (e.g., the DDI 14 of FIG. 1).

According to various embodiments, the vertical blank line may include a vertical front porch (VFP) and a vertical back porch (VBP), and when the number of the vertical blank lines is changed from the first number to the second number, a rate of change of VFP may be greater than a rate of change of VBP.

According to various embodiments, a ratio of the first refresh rate to the second refresh rate may be less than a ratio of the second time period to the first time period.

According to various embodiments, a ratio of the first refresh rate to the second refresh rate may be greater than a ratio of the second number d to the first number.

According to various embodiments, the display driver IC (e.g., the DDI 14 of FIG. 1) may change the number of vertical blank lines or the output time during a time interval between consecutive frames when change from the first refresh rate to the second refresh rate is made.

According to various embodiments, the processor (e.g., the processor 12 of FIG. 1 or the processor 820 of FIG. 8) may display an interface indicating that a user input for changing a refresh rate is received, generate the control signal in response to the user input, and transmit the control signal to the display driver IC (e.g., the DDI 14 of FIG. 1).

According to various embodiments, the processor (e.g., the processor 12 of FIG. 1 or the processor 820 of FIG. 8) may change a time period that is an output time for one of lines constituting the display panel (e.g., the display panel 16 of FIG. 1 or the display device 860 of FIG. 8).

According to various embodiments, the processor (e.g., the processor 12 of FIG. 1 or the processor 820 of FIG. 8) may control the display driver IC (e.g., the DDI 14 of FIG. 1) to operate at the first refresh rate, when a first type of application is executed, and control the display driver IC (e.g., the DDI 14 of FIG. 1) to operate at the second refresh rate when a second type of application is executed.

According to various embodiments, the processor (e.g., the processor 12 of FIG. 1 or the processor 820 of FIG. 8) may control the display driver IC (e.g., the DDI 14 of FIG. 1) to switch from the first refresh rate to the second refresh rate based on at least one of a user input, a change in communication state, and a change in option of a running application.

According to various embodiments, a screen display method, the method being performed by an electronic device (e.g., the electronic device 10 of FIG. 1 or the electronic device 801 of FIG. 8) including a display panel, may include setting, by a display driver IC of the electronic device, an output time (horizontal time) of one of lines constituting the display panel to a first time period, setting a number of vertical blank lines for the display panel to a first number, and driving the display panel at a first refresh rate, receiving, by the display driver IC, receiving a control signal for changing from the first refresh rate to a second refresh rate from a processor of the electronic device, and setting, by the display driver IC, the output time to a second time period or setting the number of the vertical blank lines to a second number and driving the display panel, wherein the display panel may output an image at the second refresh rate while the second time period and the second number of vertical blank lines is being set, the first time period may be different from the second time period, and the first number may be different from the second number.

According to various embodiments, the setting of the number of vertical blank lines to the second number may include changing from the first refresh rate to a third refresh rate between the first refresh rate and the second refresh rate based on the signal, and changing to the second refresh rate after having changed to the third refresh rate.

According to various embodiments, the changing to the third refresh rate may include performing setting to change from at least one of the first time period and the first number to a third time period and a third number respectively for changing to the third refresh rate, wherein the third time period has a value between the first time period and the second time period, and the third number has a value between the first number and the second number.

According to various embodiments, the first refresh rate may be a value in a range of 50 to 70 Hz, and the second refresh rate may be a value in a range of 110 to 130 Hz.

According to various embodiments, information on the second time period and the second number is received from the processor (e.g., the processor 12 of FIG. 1 or the processor 820 of FIG. 8) or stored in the display driver IC (e.g., the DDI 14 of FIG. 1).

According to various embodiments, the vertical blank line may include a vertical front porch (VFP) and a vertical back porch (VBP), and when the number of the vertical blank lines is changed from the first number to the second number, a rate of change of VFP may be greater than a rate of change of VBP.

According to various embodiments, the screen display method may further include generating the signal for instructing operation at the first refresh rate when a first type of application is executed in the processor (the processor 12 of FIG. 1 or the processor 820 of FIG. 8), and the signal for instructing operation at the second refresh rate when a second type of application is executed in the processor.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "1st" and "2nd", or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via at least a third element.

As used herein, the term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 840) including one or more instructions that are stored in a storage medium (e.g., internal memory 836 or external memory 838) that is readable by a machine (e.g., the electronic device 801). For example, a processor (e.g., the processor 820) of the machine (e.g., the electronic device 801) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

The invention claimed is:

1. An electronic device comprising:

a display panel;

a display driver IC (integrated circuit) configured to drive the display panel; and a processor, wherein the display driver IC is configured to:

set an output time of each line constituting the display panel to a first time period, set a number of vertical blank lines for the display panel to a first number, drive the display panel at a first refresh rate corresponding to the first time period and the first number of the vertical blank lines;

receive a control signal, for changing from the first refresh rate to a second refresh rate, from the processor; and based on receiving the control signal, change the set output time to a second time period while the set number of vertical blank lines is maintained and change the set number of vertical blank lines to a second number while the set output time is maintained, and drive the display panel at the second refresh rate corresponding to the second time period and the second number of the vertical blank lines, wherein the first time period is different from the second time period, and wherein the first number is different from the second number.

2. The electronic device of claim 1, wherein the display driver IC is configured to:

change from the first refresh rate to a third refresh rate between the first refresh rate and the second refresh rate based at least on the control signal, and change to the second refresh rate after having changed to the third refresh rate.

3. The electronic device of claim 2, wherein the display driver IC is configured to:

change at least one of the first time period and the first number to at least one of a third time period and a third number, respectively, for changing to the third refresh rate, and wherein the third time period is a value between the first time period and the second time period, and the third number is a value between the first number and the second number.

4. The electronic device of claim 1, wherein the processor includes at least one of: an application processor (AP), a communication processor (CP), a sensor hub or a touch panel circuit, or a module including a micro controller unit (MCU).

5. The electronic device of claim 1, wherein information on the second time period and the second number is received from the processor and/or stored in the display driver IC.

6. The electronic device of claim 1, wherein the vertical blank lines include a vertical front porch (VFP) and a vertical back porch (VBP), and the display driver IC is configured so that when the number of the vertical blank lines is changed from the first number to the second number, a rate of change of VFP is greater than a rate of change of VBP.

7. The electronic device of claim 1, wherein a ratio of the first refresh rate to the second refresh rate is less than a ratio of the second time period to the first time period.

8. The electronic device of claim 1, wherein a ratio of the first refresh rate to the second refresh rate is greater than a ratio of the second number to the first number.

9. The electronic device of claim 1, wherein the display driver IC is configured to change the number of vertical blank lines and/or the output time during a time interval between consecutive frames when the first refresh rate is changed to the second refresh rate.

10. The electronic device of claim 1, wherein the processor is configured to:

display an interface indicating that a user input for changing a refresh rate is received;

generate the control signal in response to the user input; and transmit the control signal to the display driver IC.

11. The electronic device of claim 10, wherein the processor is configured to change a time period that is the output time.

12. The electronic device of claim 1, wherein the processor is configured to:

control the display driver IC to operate at the first refresh rate, when a first type of application is executed; and control the display driver IC to operate at the second refresh rate, when a second type of application is executed.

13. The electronic device of claim 1, wherein the processor is configured to control the display driver IC to switch from the first refresh rate to the second refresh rate based at least on at least one of: a user input, a change in communication state, and a change in option of a running application.

14. A screen display method, the screen display method being performed by an electronic device including a display panel, the screen display method comprising:

setting, by a display driver IC of the electronic device, an output time of each line constituting the display panel to a first time period, setting a number of vertical blank lines for the display panel to a first number, and driving the display panel at a first refresh rate;

receiving, by the display driver IC, a control signal for changing from the first refresh rate to a second refresh rate from a processor of the electronic device; and based on receiving the control signal, changing the set output time to a second time period while the set number of vertical blank lines is maintained and changing the set number of vertical blank lines to a second number while the set output time is maintained, and driving, by the display driver IC, the display panel at the second refresh rate corresponding to the second time period and the second number of the vertical blank lines, wherein the first time period is different from the second time period, and wherein the first number is different from the second number.

15. The screen display method of claim 14, wherein the method includes the setting of the number of vertical blank lines to the second number, which includes:

changing from the first refresh rate to a third refresh rate between the first refresh rate and the second refresh rate based on the signal; and changing to the second refresh rate after having changed to the third refresh rate.

* * * * *